US006547832B1

(12) United States Patent
Freudemann et al.

(10) Patent No.: US 6,547,832 B1
(45) Date of Patent: Apr. 15, 2003

(54) FINISHING FOR JEANS MATERIAL

(75) Inventors: Fred Freudemann, Efringen-Kirchen (DE); Kurt Poppenwimmer, Allschwil (CH)

(73) Assignee: Clariant Finance (BVI) Limited, Tortola (VG)

( * ) Notice: Subject to any disclaimer, the term of this patent is extended or adjusted under 35 U.S.C. 154(b) by 0 days.

(21) Appl. No.: 09/509,883

(22) PCT Filed: Sep. 30, 1998

(86) PCT No.: PCT/IB98/01514

§ 371 (c)(1),
(2), (4) Date: Jul. 10, 2000

(87) PCT Pub. No.: WO99/18280

PCT Pub. Date: Apr. 15, 1999

(30) Foreign Application Priority Data

Oct. 3, 1997 (EP) ..... 97810730

(51) Int. Cl.[7] ..... D06M 0/00; D06M 11/00; D06M 13/322

(52) U.S. Cl. ..... 8/115.51; 8/116.1; 8/194; 428/365; 427/339

(58) Field of Search ..... 8/115.15, 116.1, 8/194; 428/365; 427/339

(56) References Cited

U.S. PATENT DOCUMENTS 3,881,047 A * 4/1975 Massy et al. ..... 428/378

* cited by examiner

*Primary Examiner*—Yogendra N. Gupta
*Assistant Examiner*—Derrick G. Hamlin
(74) *Attorney, Agent, or Firm*—Scott E. Hanf

(57) ABSTRACT

Process for the yellowing-inhibiting finishing of textile, indigo-dyed, washed and/or stonewashed and/or bleached denim articles, characterized in that the finishing is carried out from aqueous medium with protonated fatty acid ester-aminoamides and/or hydroxyaminoamides of N-(β-hydroxyethyl)ethylenediamine, in which the fatty acid radicals each contain from 12 to 22 carbon atoms and which have been protonated with at least 1.5 equivalents of orthophosphoric acid per equivalent of basic amino groups.

19 Claims, No Drawings

FINISHING FOR JEANS MATERIAL

BACKGROUND OF THE INVENTION

EP-A-0230910 discloses textile treatment compositions prepared by reacting $C_{10-22}$-fatty acids with polyamines and neutralizing the reaction product with a non-oxidizing inorganic acid, where, as polyamine, aminoethylethanolamine, inter alia, and, as inorganic acid, phosphorous acid are preferred and are described in the examples. The acid is employed in a defined amount of from 0.7 to 1.3 acid equivalents per amine equivalent (EP-A-0230910, page 3, line 17), i.e. in an amount which is not sufficient to achieve an acidic pH for the dibasic phosphorous acid. If this acid is employed in such amounts that an acidic dispersion is formed, this dispersion is unstable and, on standing, soon separates into two phases of different concentration, which is unsuitable for practice (production, sale, storage and use). EP-A-0230910 also mentions good results with respect to odor on page 3, line 6. It should be commented in this respect that although phosphorous acid is itself odor-free, a strong disagreeable odor spreads under acidic conditions in the presence of the other products, which is also unsuitable for practice. Thus, for example, use in alkaline wash liquors or thereafter is mentioned on page 3, lines 34–35.

The principal object in EP-A-0230910 is to avoid discoloration or yellowing of textile material which is caused immediately after finishing, for example with a fabric softener, due to subsequent heat treatment, in particular due to thermosol treatment, as is usual for synthetic fibers, with the consequence that the heat-set material appears more yellowish or brownish.

However, an essentially different problem is yellowing which does not occur until some time after completion of the textile goods which have not yellowed due to the various treatment stages in their production, namely exclusively in jeans goods, which are essentially cellulose-containing (in general cotton-containing) fabrics which have been woven or knitted in a certain manner and dyed in a certain manner and may have been subjected to further treatment in a certain manner.

The fabrics used for jeans (denim fabrics) are generally made from dyed, usually warp-dyed, warp yam and undyed weft yam, which are usually woven or knitted in such a way that the dyed part predominates on the face side of the fabric, while the undyed part predominates on the reverse side of the fabric, for example by means of the twill weaving method (for example ⅓ or ½) or by another weaving or knitting method which is suitable for this purpose. The dyeing is usually carried out using indigo dyes, such as, for example, Colour Index Vat Blue 1 or similar dyes. By means of various fading treatments, such as, for example, stonewashing, bleaching and/or washing, the jeans article can be given the known fashionable worn appearance. However, it has now been found that on storage the denim articles (jeans articles) treated in this way yellow over time, for example due to the action of constituents from the ambient air, such as ozone, nitrogen oxides, etc., especially in combination with daylight. Although the yellowing could be removed again from the made-up and yellowed goods by suitable washing, such washing processes are, however, normally not carried out by the ultimate retailer. Attempts have therefore been made to delay this yellowing effect by using certain finishing compositions, but the undesired yellowing occurs after a certain time which is relatively short for storage and/or sales purposes. There is therefore a wish to employ compositions which have a stronger or longer yellowing-inhibiting action so that the goods can be stored and/or displayed for a longer time without yellowing damage and can be offered for sale in perfect condition.

SUMMARY OF THE INVENTION

It has now been found that a surprisingly good improvement in the yellowing-inhibiting action against this storage yellowing on jeans goods can be achieved using the phosphates defined below, from salt formation of the defined amino compounds with at least 1.5 equivalents of orthophosphoric acid per equivalent of basic amino groups, whose dispersions are very stable even under acidic conditions.

The invention relates to the use of the defined phosphates for inhibiting said yellowing and to the process for yellowing-inhibiting finishing therewith.

DESCRIPTION OF THE PREFERRED EMBODIMENTS

The invention thus provides a process for the yellowing-inhibiting finishing of textile, indigo-dyed, washed and/or stonewashed and/or bleached denim articles which is characterized in that the finishing is carried out from aqueous medium with protonated fatty acid ester-aminoamides and/or hydroxyaminoamides of N-(β-hydroxyethyl) ethylenediamine in which the fatty acid radicals each contain from 12 to 22 carbon atoms and which have been protonated with at least 1.5 equivalents of ortho-phosphoric acid per equivalent of basic amino groups.

The protonated fatty acid ester-aminoamides and/or hydroxyaminoamides to be employed in accordance with the invention are advantageously employed in the form of protonated condensates of the said $C_{12-22}$-fatty acids with N-(β-hydroxyethyl)ethylenediamine.

Suitable fatty acids are any desired, preferably linear fatty acids having 12 to 22 carbon atoms which are conventional per se, preferably saturated fatty acids, for example lauric acid, myristic acid, palmitic acid, stearic acid, arachic acid and behenic acid. Both individual acids and technical-grade acids (acid mixtures), such as, for example, hydrogenated tallow fatty acid, can be employed. Of the said acids, those having from 14 to 18 carbon atoms, and also technical-grade mixtures of such acids, are preferred.

The condensates [i.e. products of the acylation of N-(β-hydroxyethyl)ethylenediamine] can be prepared in a manner known per se by condensation of the said fatty acids with N-(β-hydroxyethyl)ethylenediamine under water-eliminating conditions. For their preparation, from 1 to 2.5 mol, preferably from 1.2 to 2.2 mol, in particular from 1.4 to 2 mol, of fatty acid are advantageously employed per mole of N-(β-hydroxyethyl)ethylenediamine. The condensation is advantageously carried out in an anhydrous medium, most simply in the absence of solvents, for example at temperatures in the range from 140 to 220° C., advantageously under an inert atmosphere (for example under nitrogen) and/or optionally under reduced pressure. In addition to the above-mentioned monoamides, the said condensates may optionally, depending on the molar ratio and condensation conditions, contain further amides, namely diamides, i.e. at least one fatty acid diamide and/or at least one fatty acid ester diamide of N-(β-hydroxyethyl) ethylenediamine. Besides the amide groups, the acylation product prepared in this way—referred to below as "aminocondensate"—contains basic amino groups, which are now at least partially protonated with phosphoric acid to give the corresponding aminocondensate-phosphoric acid salt. The proportion of protonatable basic amino groups in the aminocondensate can be determined by measuring the amine number. The amine number is advantageously in the range from 30 to 100 mg, preferably from 50 to 70 mg, of KOH per g of aminocondensate. From 0.5 to 1.1 mol, preferably from 0.8 to 1 mol, of phosphoric acid are advantageously employed per mole-equivalent of basic amino groups (or amino nitrogen) in the aminocondensate.

The phosphoric acid is advantageously employed in the form of an aqueous solution, for example—calculated as ortho-phosphoric acid $H_3PO_4$—as a 1 to 10% by weight solution.

It is advantageous to add a hydrophilic, nonionogenic surfactant, preferably having an HLB of >12, for example a product of the addition of from 10 to 70 mol, preferably from 25 to 60 mol, of ethylene oxide onto 1 mol of $C_{9-24}$-fatty alcohol. Suitable fatty alcohols are any desired, preferably saturated alcohols having 9 to 24 carbon atoms, preferably 11 to 18 carbon atoms, which are conventional per se; for example, linear fatty alcohols, such as lauryl alcohol, myristyl alcohol, cetyl alcohol or stearyl alcohol, or branched fatty alcohols, such as synthesis alcohols, for example having 9 to 15 carbon atoms, preferably 11 to 15 carbon atoms, can be employed. From 1 to 30 parts by weight, preferably from 2 to 15 parts by weight, of surfactant are advantageously employed per 100 parts by weight of aminocondensate-phosphoric acid salt. In accordance with an advantageous procedure, the nonionogenic surfactant is mixed with the aminocondensate before the addition of the phosphoric acid, and the mixture is then advantageously added, preferably as a melt, to the aqueous phosphoric acid. The amount of water in the aqueous phosphoric acid is advantageously selected so that the concentration of aminocondensate-phosphoric acid salt in the aqueous preparation is in the range from 5 to 40% by weight, preferably from 10 to 30% by weight. The pH of the aqueous dispersions corresponds to the amounts of the components employed, particularly of the phosphoric acid, and is principally $\leqq 6$ in these dispersions, advantageously in the range from 2 to 6, preferably from 2 to 4.5, in particular from 2.5 to 4.5. The term "aminocondensate-phosphoric acid salt" here is taken to mean the above-described product of the reaction of phosphoric acid with the entire aminocondensate.

The above-mentioned fatty acid ester-aminoamides and/or fatty acid hydroxyaminoamides protonated with phosphoric acid, advantageously in the form of the protonated aminocondensates mentioned, preferably as aqueous formulations as described, can be employed for final finishing for yellowing inhibition.

The substrates are generally made-up articles (jeans goods) produced from indigo-dyed denim fabric which have been faded by conventional treatment known per se, in particular by washing and/or stonewashing (generally with pumice stones) and/or bleaching to give the typical jeans look.

Suitable dyes for dying the warp yarn are the known vat dyes from the indigo series, principally blue dyes, and optionally also indigo-like sulfur dyes, the latter, for example, in combination with blue vat dyes from the indigo series. For weaving or knitting, the yarns are generally sized, so that the made-up goods usually still contain the sizing agent before the said fading. For making-up, the fabric is optionally finished with a lubricant, for example a sewability improver. These auxiliaries can be removed, for example by washing, during the fading treatment.

The made-up denim goods can be faded using known processes, auxiliaries and machines—by washing and/or stonewashing and/or bleaching.

For washing, use can be made of known detergents, for example anionic or nonionogenic detergents. If desired, an enzymatic hydrolytic treatment, for example with hydrolases (for example cellulases) can be carried out at the same time. If an enzymatic treatment is carried out at the same time, it is advantageous to employ nonionogenic detergents, for example optionally end-capped products of the addition of ethylene oxide and optionally propylene oxide onto high-molecular-weight fatty alcohols, principally products of the addition of from 5 to 50 mol of ethylene oxide and optionally propylene oxide (where ethylene oxide is preferably preponderant) onto one mol of $C_{9-18}$-fatty alcohol.

For washing, use can be made, if desired, of additives as can be employed for desizing, for example sequestrants—for example polycarboxylic acids, such as polyacrylic acids, and combinations thereof with saccharides, or non-polymeric polycarboxylic acids, such as, for example, citric acid, gluconic acid, NTA or EDTA—and/or enzymes (for example $\alpha$-amylases or cellulases)—as can, as is known, be employed as biocatalysts for desizing. Such sequestrants are described, for example, in EP-A 0465286, 0465287 and 0433010; suitable enzymes are described, for example, in "Textilbetrieb" 1983/07, Volume 101, page 44.

After the desizing, a stonewashing process can be inserted if desired, optionally in combination with an enzymatic hydrolytic treatment. For the stonewashing, use can be made of stonewashing agents known per se, principally pumice stones or additives with an analogous action.

After the desizing and/or after the stonewashing, a washing process can, if desired, be carried out for anti back-staining or in order to remove stonewashing residues.

The washing process and/or the stonewashing process and, if desired, the hydrolysis process and/or washing process can if desired be repeated a number of times in order to increase the effect.

For the bleaching, use can be made of known bleaches, for example oxidants, reducing agents and/or enzymes.

For oxidative bleaching, known oxidizing bleaches, for example chlorine, e.g. in the form of hypochlorite (most simply in the form of KClO, for example as Javelle water), or peroxides, such as, for example, hydrogen peroxide, or other per compounds, such as, for example, potassium permanganate, or with suitable enzymes, are suitable.

For reductive bleaching, any desired reducing agents as usually employed for reducing vat dyes to the leuko form, for example reducing saccharides, principally aldoses, for example mono- and oligosaccharides, are generally suitable.

The said treatments by washing and/or stonewashing and/or bleaching can be carried out in one or more steps and/or repetitions. In general, from two to six, preferably three or four treatments, which may be identical or different, are carried out in industry. Thus, for example, washing (desizing) can be carried out in a first step, and bleaching, for example with or without enzymatic treatment, can be carried out in one or more subsequent steps. Stonewashing treatment, for example with pumice stones, can be carried out in any desired one of these treatment steps, preferably together with cellulases.

After the last of these treatment steps, the final treatment according to the invention with the above-defined aminocondensate-phosphoric acid salt can be carried out in the same sequence and in the same apparatus. The treatment according to the invention with the above-defined aminocondensate-phosphoric acid salts is advantageously carried out by exhaust processes from an aqueous medium, for example with a liquor ratio as also used for the preceding treatments, for example from 4:1 to 30:1, preferably from 6:1 to 20:1, where the aminocondensate-phosphoric acid salts are preferably employed in the form of aqueous dispersions as described above. The aminocondensate-phosphoric acid salts are advantageously employed in suitable concentrations, based on the substrate, preferably in a concentration in the range from 0.02 to 4% by weight, particularly preferably from 0.1 to 2% by weight, based on the dry substrate. The treatment can be carried out under conditions which are conventional per se, for example in the temperature range from 15 to 95° C., preferably from 30 to 60° C., and at pH values in the acidic to weakly alkaline region, for example at a pH in the range from 3 to 8, advantageously at a pH in the range from 3 to 7, preferably from 4 to 7; in general, acidic pH values, i.e. pH <7, are preferred. The pH can be set using acids, bases and/or buffers known per se, for example using phosphoric acid, acetic acid, sodium carbonate and/or or phosphoric acid mono- or disodium salt. The treatment duration can be varied as desired and is generally selected corresponding to the substrate, the apparatus used, the product employed and the desired effect, for example in the range from 10 minutes to 1 hour, preferably from 15 minutes to 30 minutes, after which the treated goods can be removed from the machine and dried in a suitable manner, for example in a drying drum (tumbler), for example at from 40 to 80° C., or in air.

The jeans articles treated in this way are distinguished by surprisingly good and long resistance to yellowing, as caused, in particular, by air components (ozone, nitrogen oxides, etc.), especially with simultaneous action of daylight.

In the examples below, parts are by weight and percentages are percent by weight; the temperatures are given in degrees Celsius. "C.I." stands for "Colour Index", "kNU" stands for "kiloNOVO units" and "GTU" stands for GENENCOR textile units".

EXAMPLES

Example 1

700 parts of stearic acid are heated to 100° C. under nitrogen. When this temperature has been reached, 160 parts of N-(β-hydroxyethyl)ethylenediamine are added over the course of 60 minutes, and the mixture is heated to 180° C., during which the condensation reaction commences with elimination of water, which is distilled off. 30 minutes after addition of the amine, the apparatus is evacuated to a residual pressure of 140 mbar, and the condensation is continued under these conditions for 2 hours. The amine number of the resultant condensation product is 62 mg of KOH per g of condensate. A total of 50 parts of distillate are obtained. The mixture is then cooled to 80° C. and, after addition of 60 parts of stearyl poly(40)ethylene glycol ether, the resultant melt at 70–80° C. is poured into a solution of 100 parts of ortho-phosphoric acid (86%) in 3130 parts of water at 60–70° C. After 2 hours at 70–80° C., the mixture is cooled to room temperature. A stable, white, readily water-dilutable dispersion having a pH of 3 is obtained.

Application Example 5-step process:

1) Desizing
2) Stonewashing
3) Washing (anti back-staining)
4) Bleaching
5) Yellowing-inhibiting finishing 5 kg of a denim article in the form of blue jeans dyed with indigo (with C.I. Vat Blue 1) are introduced into a D'HOOGE 80 G front-loading washing machine (rotating drum with a diameter of 70 cm). 50 liters of water at 50° C. are introduced into the machine. After addition of 0.3 g/l of nonylphenol poly(9)ethylene glycol ether (wetting agent) and 1 g/l of α-amylase having 130 kNU per g (AQUAZYME 120 L from NOVO) and adjustment of the pH to 6.0±0.5, the mixture is heated to 60° C. and the washing machine is switched on at 30 rpm. After 15 minutes, the bath is discharged and the machine is re-filled to the same level with cold water. The water is then heated to 40–45° C., and the pH is adjusted to 5.5±0.2 using a little acetic acid. 2.5 kg (50%, based on the goods weight) of pumice stones and 25 g (0.5%, based on the goods weight) of acid cellulase having 6500 GTU per g (INDIAGE SUPER GX from GENENCOR) are added, the pH is re-adjusted to 5.5 and the machine is then allowed to run at 30 rpm at 40–45° C. for 60 minutes. The bath is subsequently discharged, the goods are rinsed once at 70–80° C., and the machine is then re-filled with water to the same level. 10 g of dodecylbenzene-sulfonic acid sodium salt are added, and the machine is allowed to run at 60° C. for 10 minutes. The bath is then discharged, and the goods are rinsed once warm at 70–80° C. The machine is then re-filled with water to the same level and heated to 40° C. The pH is then adjusted to 8.0±0.2 using sodium carbonate, and sufficient Javelle water is added so that 2 g/l of active chlorine can be titrated. After 15 minutes at 40° C., the goods are rinsed once warm (40° C.) and once cold (room temperature), then the machine is re-filled with water to the same level and heated to 40° C. After the pH has been adjusted to 5–6 using phosphoric acid, 150 g of the dispersion according to Example 1 are added, and the goods are treated at 40° C. for 20 minutes. The bath is then discharged, and the denim textile goods are unloaded and dried at 70–80° C. in the tumble drier.

The goods finished in this way have high protection against yellowing caused by ambient air and can be stored uncovered in air for an extended period without significant adverse yellowing.

What is claimed is:

1. Process for the yellowing-inhibiting finishing of textile, indigo-dyed, washed and/or stonewashed and/or bleached cotton denim articles, characterized in that the finishing is carried out from aqueous medium with protonated fatty acid ester-aminoamides and/or hydroxyaminoamides of N-(β-hydroxyethyl)ethylenediamine, in which the fatty acid radicals each contain from 12 to 22 carbon atoms and which have been protonated with at least 1.5 equivalents of ortho-phosphoric acid per equivalent of basic amino groups.

2. Process according to claim 1, characterized in that the protonated fatty acid ester-aminoamide and/or hydroxyaminoamide is employed as a mixture with at least one fatty acid diamide of N-(β-hydroxyethyl)ethylenediamine and/or fatty acid ester diamide of N-(β-hydroxyethyl)ethylenediamine, in which the fatty acid radicals each contain from 12 to 22 carbon atoms.

3. Process according to claim 1, characterized in that a product of the acylation of N-(β-hydroxyethyl) ethylenediamine with at least one $C_{12-20}$-fatty acid, which product has been protonated with at least 1.5 equivalents of ortho-phosphoric acid per equivalent of basic amino groups, is employed.

4. Process according to one of claim 1, 2 or 3, characterized in that an acylation product which has been protonated with from 0.5 to 1.1 mol of phosphoric acid per mole-equivalent of basic amino groups in the aminocondensate is employed.

5. Process according to one of claim 1, 2 or 3, characterized in that, in addition, a hydrophilic, nonionogenic surfactant is employed.

6. Process according to one of claim 1, 2 or 3, characterized in that the products protonated with phosphoric acid are employed in the form of an aqueous dispersion.

7. Process according to one of claim 1, 2 or 3, characterized in that the products protonated with phosphoric acid are employed in the form of an aqueous dispersion having a pH of from 2 to 6.

8. Process according to one of claim 1, 2 or 3, characterized in that the finishing is carried out at pH <7.

9. Process according to one of claim 1, 2 or 3, characterized in that the denim articles to be treated have been subjected to bleaching.

10. Process according to one of claim 1, 2 or 3, characterized in that the denim articles to be treated have been subjected to at least one enzymatic treatment.

11. Process for the yellowing-inhibiting finishing of textile, indigo-dyed, washed and/or stonewashed and/or bleached denim articles, where the finishing is carried out from aqueous medium with protonated fatty acid ester-aminoamides and/or hydroxyaminoamides of N-(β-hydroxyethyl)ethylenediamine, in which the fatty acid radicals each contain from 12 to 22 carbon atoms, where said protonated fatty acid ester-aminoamide and/or hydroxyaminoamide is employed as a mixture with at least one fatty acid diamide of N-(β-hydroxyethyl)ethylenediamine and/or fatty acid ester diamide of N-(β-hydroxyethyl)ethylenediamine, in which the fatty acid radicals each contain from 12 to 22 carbon atoms and which have been protonated with at least 1.5 equivalents of ortho-phosphoric acid per equivalent of basic amino groups.

12. Process according to claim 11, where a product of the acylation of N-(β-hydroxyethyl)ethylenediamine with at least one $C_{12-20}$-fatty acid, which product has been protonated with at least 1.5 equivalents of ortho-phosphoric acid per equivalent of basic amino groups, is employed.

13. Process according to claim 11, where an acylation product which has been protonated with from 0.5 to 1.1 mol of phosphoric acid per mole-equivalent of basic amino groups in the aminocondensate is employed.

14. Process according to claim 11, where, in addition, a hydrophilic, nonionogenic surfactant is employed.

15. Process according to claim 11, where the products protonated with phosphoric acid are employed in the form of an aqueous dispersion.

16. Process according to claim 11, where the products protonated with phosphoric acid are employed in the form of an aqueous dispersion having a pH of from 2 to 6.

17. Process according to claim 11, where the finishing is carried out at pH <7.

18. Process according to claim 11, where the denim articles to be treated have been subjected to bleaching.

19. Process according to claim 11, where the denim articles to be treated have been subjected to at least one enzymatic treatment.

* * * * *